United States Patent [19]

Heinz

[11] 4,267,638

[45] May 19, 1981

[54] PROTECTED PIVOT ADJUSTABLE SCALED COMPASSES

[76] Inventor: Richard A. Heinz, 76 Woodhaven Rd., Glastonbury, Conn. 06033

[21] Appl. No.: 56,828

[22] Filed: Jul. 12, 1979

Related U.S. Application Data

[63] Continuation-in-part of Ser. No. 891,899, Mar. 30, 1978, abandoned.

[51] Int. Cl.[3] ..... B43L 9/04

[52] U.S. Cl. ..... 33/27 C

[58] Field of Search ..... 33/27 C, 27 R, 31, 489, 33/482, 483, 477, 487

[56] References Cited

U.S. PATENT DOCUMENTS

| | | | |
|---|---|---|---|
| 776,897 | 12/1904 | Ferris | 33/27 C |
| 1,447,207 | 3/1923 | Golden | 33/27 C X |
| 1,498,870 | 6/1924 | Fox | 33/27 C |
| 2,063,776 | 12/1936 | Wozny | 33/27 C |
| 2,542,537 | 2/1951 | Klemm | 33/27 C |
| 3,292,262 | 12/1966 | Moll | 33/27 C |
| 3,315,361 | 4/1967 | Mutter | 33/27 C |
| 3,474,538 | 10/1969 | Kirkegaard | 33/27 C X |
| 3,513,548 | 5/1970 | Itano | 33/27 C |

FOREIGN PATENT DOCUMENTS

| | | | |
|---|---|---|---|
| 495942 | 9/1950 | Belgium | 33/489 |
| 66031 | 12/1947 | Denmark | 33/27 C |
| 2527950 | 6/1976 | Fed. Rep. of Germany | 33/27 C |
| 186297 | 1/1937 | Switzerland | 33/31 |

*Primary Examiner*—Harry N. Haroian

[57] ABSTRACT

A protected pivot adjustable scaled compasses including a slotted body marked with multiple scales. A spring loaded transparent push button with pivot point retractable within the body support. A transparent movable slide arrangement with locking mechanism supported by and positioned over the scaled body. The slide configured with multiple sized holes intersecting alignment marks for use in conjunction with the scales to accurately set and circumscribe arcs or circles using a variety of readily available marking instruments. A washer used in conjunction with the slide locking screw to raise the slide and body during ink application and lower the slide and body when a pencil or scribe is used.

4 Claims, 3 Drawing Figures

PROTECTED PIVOT ADJUSTABLE SCALED COMPASSES

This application is a continuation-in-part of Ser. No. 891,899, March 30, 1978, now abandoned.

BACKGROUND OF THE INVENTION

A variety of mechanical drawing aids exist for use to construct arcs and circles and with the exception of circle templates these fall into two categories: namely, the bow divider and the beam compasses. These instruments are generally constructed in such a manner as to present one or more sharp and potentially dangerous points to the user. In addition, to construct an arc of given radius the actual measurement must be transferred from a separate scale or measure. None offer the versatility of easily using a large variety of readily available marking devices ranging from the India ink pen, felt tip marker, ball point pen, or pencil to the scribe while being of a size and configuration that can be carried in the user's pocket or notebook.

SUMMARY OF THE INVENTION

The object of this invention is to provide a simple, inexpensive drawing instrument that can be carried in the user's shirt pocket that has great versatility in that it can be used to construct an infinite number of arcs, circles, angles, and straight lines and provide a variety of symbols for use in identifying points on curves, and measure the circle diameters and line lengths with great speed and accuracy while permitting a large range of readily available drawing instruments to be used construct the lines ranging from the pencil to India ink pens.

This invention describes an adjustable radius compasses that embodies certain features which overcome disadvantages of the prior art in the ease of locating the center of the desired radius to be constructed and in the accuracy and ease of setting an infinite number of selected radii of arc while permitting the use of a large variety of readily available sizes and types of marking instruments and media to be used including India ink, with provision for protection of the user against injury from the normally unprotected sharp pivot point and prevents the point from accidentally coming into contact with other objects that is greatly improved over prior art devices.

This invention provides a flat, slotted, ruler-like body housing a transparent spring loaded push button which supports a sharp center pivot point at the intersection of inscribed cross hairs. The cross hairs are used to locate the push botton over the desired arc center by optical means and finger pressure is applied to the push button to displace the center point from its protected position and set the pivot center of the device after which the body is rotated about the pivot to circumscribe an arc or circle. A restoring spring returns the sharp pivot point to a protected position within the body after finger pressure is removed from the push botton thus providing a means to prevent the sharp point from contacting any object or person after its function is completed.

This invention also provides an instrument with a body on which multiple scales are positioned which, in conjunction with an adjustable transparent slide arrangement that allows a variety of types and sizes of readily available marking or scribing devices to be used, permits rapid and accurate selection of the desired radius of arc to be set and subsequently circumscribed thus increasing the usability of the device.

Another feature of this invention is a washer of precise thickness that is used in conjunction with the locking screw on the slide. When placed on the underside of the slide, it lowers the flat headed slide locking screw which supports and raises the slide and body to permit India ink to be used without smearing and when repositioned to the top of the slide lowers the slide guide opening to permit more accurate pencil or scribe lines to be constructed.

This invention further provides a body and adjustable slide arrangement that is configured in such a manner as to allow the body to be used as an independent scale or ruler while the transparent slide can be used as an independent means to convert units from one scale to another thus increasing the versatility of the device.

In the preferred embodiment the invention consists of a slotted body with several different scales, e.g. English and metric, configured in such a fashion as to allow an infinitesimally variable position transparent slide, with a locking mechanism, to select the desired radius of the arc or circle to be constructed while permitting the use of a variety of types and sizes of any readily available marking instruments such as a felt marker, pen, pencil, scribe or India ink pen to be utilized by inserting the selected instrument through the slide and body slot in circumscribing the desired radius of arc or circle, the center of which is easily located by optical means over the desired center of arc and set by depressing a spring loaded transparent pivot from its protected position in the body. When released, the pivot or center pin retracts to a position within the body that protects the sharp point from accidentally coming into contact with any person or object. A washer of precise thickness is used in conjunction with the locking screw on the slide such that when it is placed on the underside of the slide between the slide and screw head, it raises the slide and body so that ink can be used without smearing and when it is placed under the lock nut on top of the slide it lowers the slide to touch the surface being marked thus permitting more accurate lines to be constructed with a pencil or scribe. The configuration of the body, scales, adjustable slide, and retractable pivot point is such that the device can be further utilized as a ruler, a scale, or for conversion of units between the scales; e.g. metric to English. One end of the body is extended to provide a template of circles that cover the range of sizes below that which can be formed by the minimum gap between the pivot and marking device when the slide is against the stop on the pivot end of the body. This extension can also be used to provide a place for markings which can be used to measure or set angles with the pivot center as their vertex and the extension can also be cut out to provide symbol guide configurations to aid in curve plotting, thus furthering its usability.

BRIEF DESCRIPTION OF THE DRAWING

An understanding of the invention and advantages thereof will become more apparent from the following description of the preferred embodiment as shown in the accompanying drawings wherein is illustrated the configuration and relationships of the body, protected pivot, slide, the washer and the flat head slide locking screw.

DESCRIPTION OF THE PREFERRED EMBODIMENTS

Figure 1:
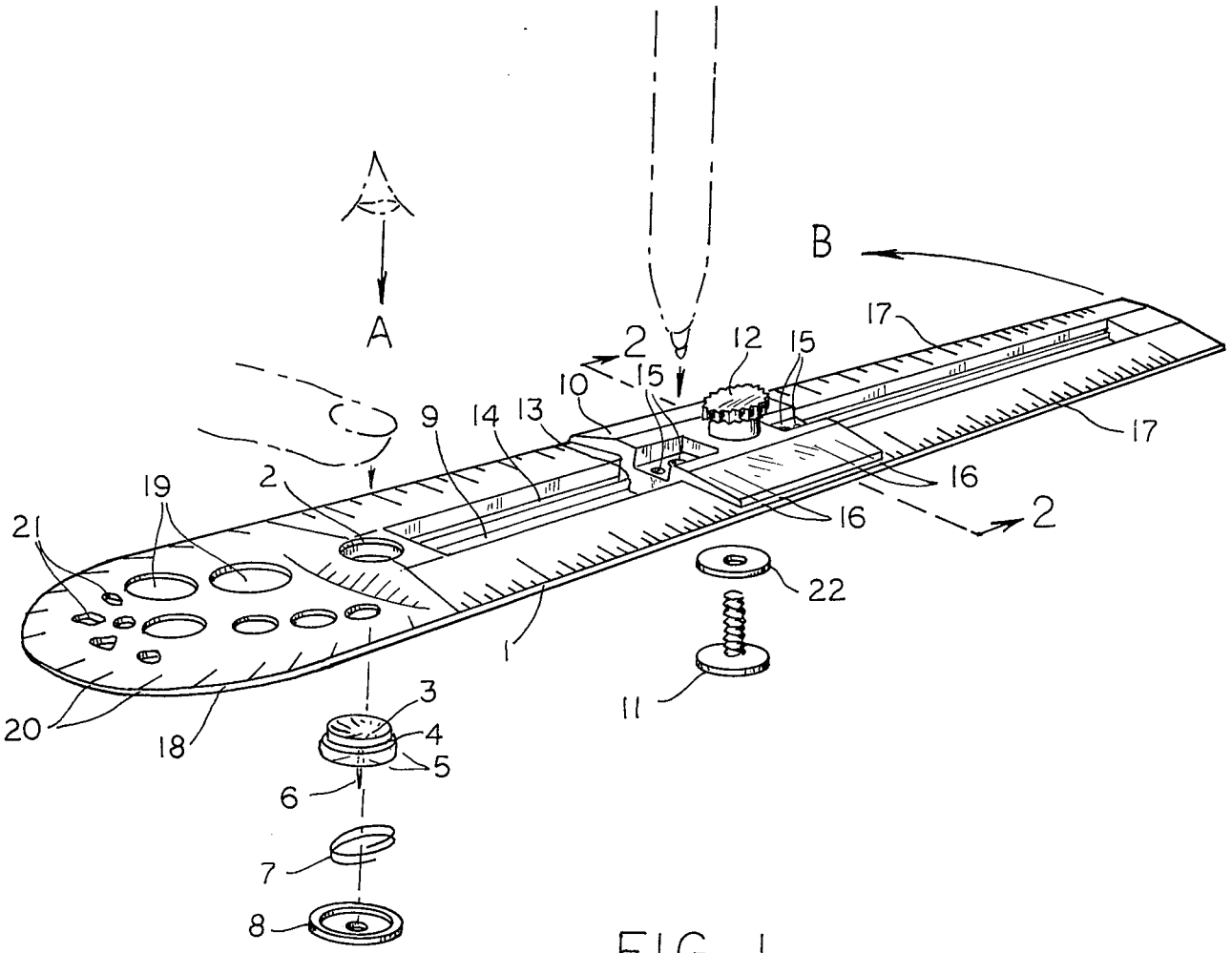
FIG. 1 is a perspective view of the protected pivot adjustable scaled compasses constructed in accordance with an illustrative embodiment of this invention.
Figure 2A:
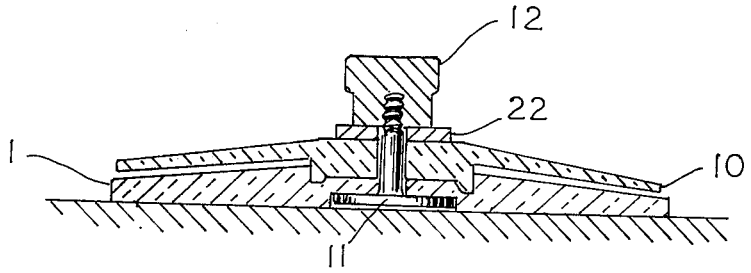
FIG. 2A is an enlarged sectional view taken through the slide and body illustrating the position of the washer when intimate contact of the body with the marking surface is desired.
Figure 2B:
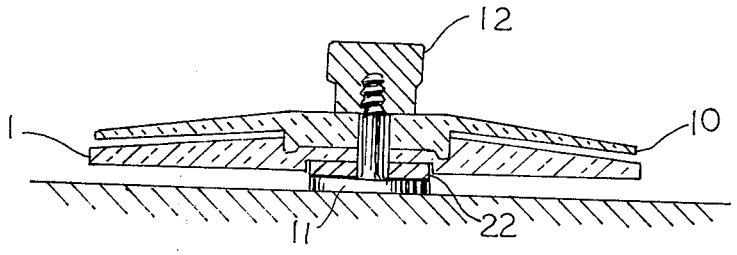
FIG. 2B is an enlarged sectional view taken through the slide and body illustrating the position of the washer and flat headed slide locking screw when it is desired to raise the slide and body away from the marking surface for use with India ink.

As shown in FIG. 1 the protected pivot adjustable scaled compasses consists of a body 1 with a hollow enclosure with a stepped down opening 2 that provides a means to house a transparent push button 3 with a stepped shoulder 4 that mates with the step in the housing enclosure, the underside of the pushbutton which is inscribed with cross hairs 5 and wherein is positioned a pivot pin 6 at the intersection of the cross hairs, a spring 7 loads the transparent push button with center pin so that the center pin would normally be enclosed by the surrounding body when no force is applied to the push button sufficient to overcome the spring force, a transparent cover 8 retains the spring and push button on one end while the mating shoulders on the push button and body opening retain the other end. The body is configured with a longitudinal slot 9 down the centerline of the body and a transparent adjustable position slide 10 which engages the body slot, the body slot being wide enough to accommodate an extension of the slide through the slot so as to bring the bottom of the slide near the base of the body. The slide which has means to be locked in place with a flat headed screw 11 which passes through the body slot and slide and nut 12. A washer 22 of precise thickness is placed under the nut and over the slide as shown in FIG. 2A when the instrument is used with a pencil or scribe and the washer is placed under the slide and while being retained by the slide locking screw, extends the flat headed slide screw thus raising the slide and body as shown in FIG. 2B when the instrument is used with ink for the purpose of eliminating an ink smear. The slide has ridges 13 on the underside which engage mating grooves 14 in the body on both sides of the body slot for the purpose of preventing the body sides adjacent to the slot from spreading apart. The slide has several holes 15 of various sizes with conical walls through the slide arranged in a line so that their centers lie on the body centerline, the body centerline which also intersects the centerline of the push button supported pivot pin, the holes in the slide therefore being aligned with the longitudinal slot in the body so that a drawing instrument may be inserted through any of the slide holes, the holes being different diameters so as to accommodate the insertion of various types and sizes of readily available drawing instruments. The slide has multiple hairlines 16 inscribed on the underside of the slide so as to reduce parallax, each hair line intersecting the center point of its respective hole and being normal to the slide axis and extending the full width of the slide thus overlaying the various scales 17 on each side of the body. The scales allow a measure of the desired radius of arc to be made by moving the appropriate hairline on the slide over the selected position on the scale and set by tightening the nut, the radius of arc to be constructed being the distance from the center of the pivot pin to the center of the selected hole in the side. A portion of the body 18 is extended and thinned beyond the pivot pin enclosure to accommodate a series of hole sizes or templates 19 that cover a range of diameters, from the minimum radius capable of being constructed with the slide and push button when the slide is against the stop adjacent to the push button housing, to the smallest practicable hole size. This extended, thinned section is also marked with angles 20 whose common vertex is the pivot pin center so that various angles can be measured or constructed. The extended section can also accommodate cut outs 21 to form guides for the marking of various symbols suitable to distinguish various different points such as might be used during curve plotting.

Use of this device is accomplished by positioning the cross hair intersection and hence the pivot pin in the push button over the desired center point of the arc or circle to be circumscribed, alignment of which is facilitated by optically sighting in direction A and subsequently depressing the transparent push button containing the center pivot point into the surface to be circumscribed. Any readily available marking instrument, for example, a felt marker or pencil, is inserted into one of the conical holes provided in the slide after the desired radius has been selected using one of the scales with the desired units on the body in conjunction with the hair line on the slide which intersects the hole being used by the marking instrument. After tightening the lock nut movement of the body in direction B about the depressed pivot point with the drawing instrument inserted through the selected hole in the slide and contacting the surface to be marked, circumscribes an arc or circle of the preselected radius. If it is desired to use a marking pen with India ink, to prevent smearing the washer would be inserted on the slide locking screw on the underside of the slide to lift up the slide and body away from the marking surface. The large flat locking screw head provides a stable support for the slide and body. Upon completion of the marking of the desired arc or circle, the drawing instrument is removed and the pressure on the push button is released allowing the spring to restore the sharp pivot point to a protected position within the body of the device, thus preventing the sharp pivot point from accidentally contacting any person or object and allowing the device to be used as a scale, or straight edge, or angle measure, or symbol guide for identifying points during curve plotting, or as a conversion of units between the different body scales by positioning a hairline on the slide over the desired point on the scales provided.

It should be understood that the present disclosure is for the purpose of illustration only and that this invention includes all modifications or equivalents which fall within the scope of the appended claims.

I claim:

1. A protected pivot adjustable scaled compass comprising a molded plastic ruler-like body with an elongated slot along its centerline, said body having scales along the edges thereof, said body having means for a retractable spring loaded protected pivot at one end of said body, said protected pivot made of transparent material in the form of a button and scribed with cross hairs, a molded slide of transparent material that fits within said body slot and overlaps said body scales, said slide having a plurality of holes at the edges aligned with said centerline, hairlines inscribed in said slide, normal to the slide and body centerline which intersect said holes in said slide, said body having on its upper surface grooves parallel to said elongated slot on either side thereof, and said slide having means mating with said grooves for sliding movement therealong, a hole through the center of said slide that permits the insertion of a locking screw with a flat head that engages an elongated recess in the body along said slot in the bottom surface of said body, said screw passes through the slide and engages a thumb nut, further comprising a precise thickness washer having a hole in its center that fits over the locking screw, said washer has a diameter the same as said locking screw head, said washer capable of being positioned below said body and slide, one side of the washer resting in said recess of the body slot and the other side of the washer resting against the underside of the head of the locking screw with said locking screw passing through holes in said washer and slide and engaging said thumb nut, or alternately said washer capable of being positioned above said body and slide, one side of said washer resting on top of the slide and the other side of the washer resting against the bottom of the thumb nut, with locking screw passing through said holes in said slide and washer and engaging the thumb nut, thereby permitting an adjustment in height of the body and slide above the surface to be marked in the former position when using ink to prevent a smear and permitting an adjustment in height of the body and slide so that the body and slide rest on the marking surface in the latter position when using a pencil or scribe for increased accuracy, the thumb nut being tightened to lock the slide in both positions.

2. The compass set forth in claim 1 wherein said head of the flat headed locking screw is of sufficient diametrical proportions relative to said body width, that when used with said washer between the head and body underside provides a stable base during rotation of the said body and slide with marker around said pivot with said lock nut tightened.

3. The compass set forth in claim 1, said protected pivot comprising a molded cavity within said body forming a circular enclosure with a stepped down opening or shoulder at the top of the cavity, said retractable pivot comprising a molded transparent button with a stepped shoulder that mates with said shoulder of said body cavity, said button inscribed with cross hairs on its bottom, said button with a pivot pin inserted at the juncture of the cross hairs, said body cavity containing a compression spring, under said button, a transparent cover attached to said body bottom at the said body cavity for holding said spring in said body cavity, said spring compressed by a said transparent cover said cover provided with a small hole in its center to allow passage of the said pivot pin when the top of said button is pressed, thereby producing an integral retractable protected pivot of shallow height.

4. The compass set forth in claim 1, said spring loaded pivot button comprising a concave top thereby guiding the finger toward the center of rotation as the body and slide are rotated about the pivot.

* * * * *